US010435256B2

(12) United States Patent
Kimura

(10) Patent No.: US 10,435,256 B2
(45) Date of Patent: Oct. 8, 2019

(54) SHEET FEEDING APPARATUS AND IMAGE FORMING SYSTEM

(71) Applicant: Konica Minolta, Inc., Tokyo (JP)

(72) Inventor: Kazuyoshi Kimura, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 39 days.

(21) Appl. No.: 14/987,095

(22) Filed: Jan. 4, 2016

(65) Prior Publication Data

US 2016/0200529 A1 Jul. 14, 2016

(30) Foreign Application Priority Data

Jan. 14, 2015 (JP) ..... 2015-005434

(51) Int. Cl.
*B65H 1/04* (2006.01)
*B65H 1/26* (2006.01)
(Continued)

(52) U.S. Cl.
CPC ..... *B65H 1/04* (2013.01); *B65H 1/14* (2013.01); *B65H 1/266* (2013.01); *B65H 3/48* (2013.01);
(Continued)

(58) Field of Classification Search
CPC .. B65H 1/04; B65H 1/266; B65H 2301/5122; B65H 2301/1422; B65H 2301/4225;
(Continued)

(56) References Cited

U.S. PATENT DOCUMENTS 3,567,216 A * 3/1971 Zeller ..... B65H 1/08 271/148
5,183,248 A * 2/1993 Okada ..... B65H 1/04 271/121
(Continued)

FOREIGN PATENT DOCUMENTS

JP S60-177127 A 9/1985
JP H11-049377 A1 2/1999
JP 2013155003 A 8/2013

OTHER PUBLICATIONS

Notification of Reasons for Refusal dated Feb. 14, 2017 from the corresponding Japanese Patent Application No. JP 2015-005434 and English translation; Total of 7 pages.

*Primary Examiner* — Ernesto A Suarez
(74) *Attorney, Agent, or Firm* — Lucas & Mercanti, LLP

(57) ABSTRACT

There are provided a sheet feeding apparatus and an image forming system which can horizontally maintain a posture of a topmost envelope in stored envelopes, by a simple configuration. The sheet feeding apparatus includes: a stacking surface portion 321; a sheet feeding roller 313; a pressing surface portion 362; and a curve forming portion 363. A length of the stacking surface portion 321 in a width direction is shorter than a length of each of envelopes P in a width direction. The pressing surface portion 362 is pressed by the sheet feeding roller 313 via the envelopes P. The curve forming portion 363 is arranged outside the sheet feeding roller 313 in a width direction, projects more upward in a vertical direction than the pressing surface portion 362, and supports the plurality of stacked envelopes P with a predetermined size.

14 Claims, 14 Drawing Sheets

(51) Int. Cl.
*B65H 1/14* (2006.01)
*B65H 3/48* (2006.01)

(52) U.S. Cl.
CPC ..... *B65H 2405/1112* (2013.01); *B65H 2405/1113* (2013.01); *B65H 2405/1116* (2013.01); *B65H 2405/15* (2013.01); *B65H 2515/81* (2013.01); *B65H 2601/1231* (2013.01); *B65H 2701/1916* (2013.01)

(58) Field of Classification Search
CPC .... B65H 2701/1218; B65H 2701/1916; B65H 2405/1112; B65H 2405/1113; B65H 2405/11131; B65H 2405/1116; B65H 2405/11161; B65H 2405/1119; B65H 2405/1132; B65H 2405/1136; B65H 2405/1138; B65H 2405/141; B65H 2405/1412; B65H 2515/81; B65H 2601/1231
See application file for complete search history.

(56) References Cited

U.S. PATENT DOCUMENTS

| | | | | |
|---|---|---|---|---|
| 6,139,008 | A * | 10/2000 | Margiotta | B65H 1/04 271/147 |
| 6,837,490 | B2 * | 1/2005 | Hirai | B65H 1/04 271/148 |
| 9,193,544 | B2 * | 11/2015 | Nakagawa | B65H 1/266 |
| 9,359,157 | B2 * | 6/2016 | Niikura | B65H 3/48 |
| 2016/0200530 | A1 * | 7/2016 | Kimura | B65H 1/20 271/2 |
| 2016/0282786 | A1 * | 9/2016 | Toshiyuki | G03G 15/6529 |

* cited by examiner

SHEET FEEDING APPARATUS AND IMAGE FORMING SYSTEM

CROSS REFERENCE TO RELATED APPLICATION

This Application claims the priority of Japanese Patent Application No. 2015-005434 filed on Jan. 14, 2015, application which is incorporated herein by reference.

BACKGROUND OF THE INVENTION

Field of the Invention

The present invention relates to a sheet feeding apparatus that feeds sheets to an image forming apparatus, and an image forming system that has the sheet feeding apparatus and the image forming apparatus. Particularly, the present invention relates to a sheet feeding apparatus that stores envelopes.

Description of the Related Art

Conventionally, there has been known a sheet feeding apparatus that feeds sheets to an image forming apparatus such as a copying machine, a printer apparatus, a facsimile apparatus, a printing machine, and a composite machine. The sheet feeding apparatus is connected to the image forming apparatus when used as an image forming system.

In recent years, there has been known an image forming system that stores, in a sheet feeding apparatus, envelopes as sheets, and forms an image on the envelopes. Since the envelope is formed in a bag shape, a pasted portion in which the sheet is overlapped and stuck is formed not only on a bottom side opposite to an opening side on which a flap portion is formed, but in the center in a width direction perpendicular to a conveying direction in the envelope (so-called center pasting) or on one side in the width direction (so-called corner pasting).

Therefore, when a number of envelopes are stored in the sheet feeding apparatus, and the envelopes are stacked, a pasted portion side in the envelopes becomes higher than a non-pasted part, and a topmost envelope inclines with respect to a horizontal surface. As a result, there is caused an disadvantage that the envelopes cannot he accurately conveyed to a conveying portion that conveys the envelopes to the image forming apparatus.

In order to solve such an disadvantage, there is disclosed in the sheet feeding apparatus described in Patent Literature 1, for example, a sheet feeding apparatus including a sheet feeding auxiliary plate that can be deformed in accordance with an inclination of the stacked envelopes. In the sheet feeding apparatus described in Patent Literature 1, the sheet feeding auxiliary plate including a pair of triangular plates is deformed using a plurality of cylinders.

RELATED ART DOCUMENT

Patent Document

Patent Literature 1: Japanese Patent Laid-Open Publication No. 2013-155003

DISCLOSURE OF THE INVENTION

Problems to be Solved by the Invention

However, a plurality of cylinders for deforming the sheet feeding auxiliary plate, and a plurality of detecting sensors for detecting a state of a posture in the topmost envelope are required for a technology described in Patent Literature 1. As a result, the technology described in Patent Literature 1 has problems in which not only the number of components increases due to the plurality of cylinders and the plurality of detecting sensors, but also a structure for horizontally keeping the posture of the topmost envelope becomes complicated.

The present invention has been made in view of conventional problems described above, and an object thereof is to provide a sheet feeding apparatus and an image forming system which can horizontally maintain a posture of the topmost envelope in stored envelopes, by a simple configuration.

SUMMARY OF THE INVENTION

In order to solve the above-described problems and to achieve the object of the present invention, a sheet feeding apparatus of the present invention includes: a stacking surface portion; a sheet feeding roller; a pressing surface portion; and a curve forming portion. A plurality of envelopes with a predetermined size can be stacked on the stacking surface portion, and a length of the stacking surface portion in a width direction perpendicular to a conveying direction of the envelopes with the predetermined size and also perpendicular to a vertical direction thereof is shorter than a length of each of the envelopes with the predetermined size in a width direction. The sheet feeding roller comes into contact with the envelope with the predetermined size arranged at a top of the plurality of envelopes with the predetermined size in the vertical direction, the envelopes being stacked on the stacking surface portion, and conveys the envelopes with the predetermined size. The pressing surface portion is pressed by the sheet feeding roller via the envelopes with the predetermined size. The curve forming portion is arranged outside the sheet feeding roller in a width direction, projects more upward in the vertical direction than the pressing surface portion, and supports the plurality of stacked envelopes with the predetermined size.

In addition, the image forming system of the present invention includes: an image forming apparatus that forms an image on envelopes; and a sheet feeding apparatus that feeds the envelopes to the image forming apparatus. The above-described sheet feeding apparatus is used as a sheet feeding apparatus.

Effects of the Invention

According to the sheet feeding apparatus and the image forming system having the above configuration, a horizontal posture of the topmost envelope in the stored envelopes can be favorably maintained by the simple configuration.

BRIEF DESCRIPTION OF THE DRAWINGS

FIG. 10A is an elevational view showing the state where the envelopes are stacked on a conventional sheet feeding apparatus; and FIG. 10B is an elevational view showing the state where the envelopes are stacked on the sheet feeding apparatus according to the first exemplary embodiment of the present invention.

FIG. 11A is the view showing a case where a curve forming member is not provided; and FIG. 11B is the view showing a case where a curve forming member is provided.

FIG. 17A is a perspective view showing a state where projecting pieces are housed; FIG. 17B is a perspective view showing a state where the projecting pieces are projected; and FIG. 17C is an elevational view showing the state where the projecting pieces are projected.

FIG. 18A is a perspective view of the curve forming member; and FIG. 18B is an elevational view thereof.

DESCRIPTION OF THE PREFERRED EMBODIMENTS

Hereinafter, modes for carrying out a sheet feeding apparatus and an image forming system of the present invention will be explained with reference to FIGS. 1 to 18B. Note that the same symbols are attached to common members in each drawing. In addition, the present invention is not limited to the following modes.

1. First Exemplary Embodiment

First, an image forming system and a sheet feeding apparatus according to a first exemplary embodiment of the present invention will be explained with reference to FIGS. 1 to 15.

Figure 1:
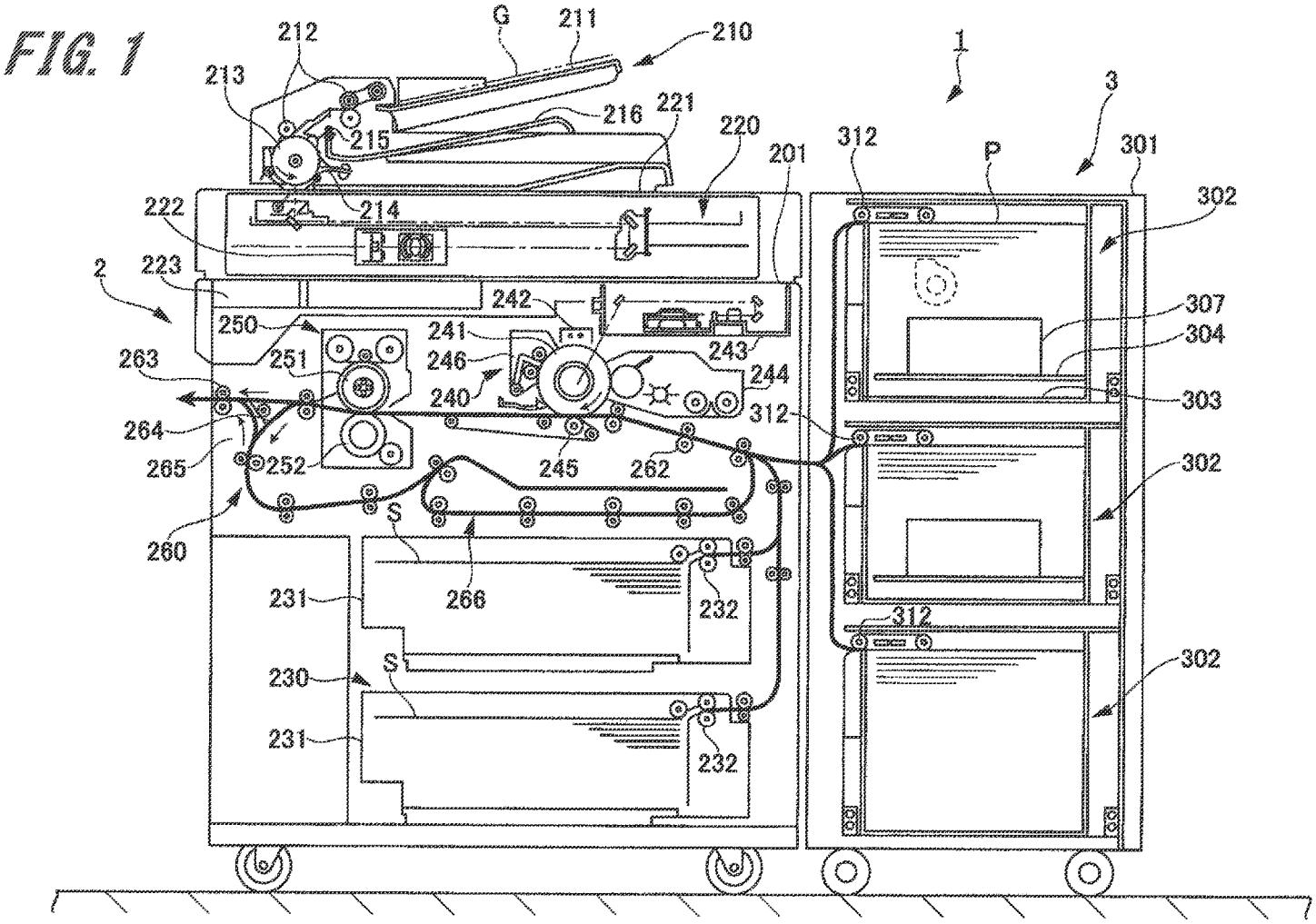
FIG. 1 is a schematic configuration view of an image forming system according to a first exemplary embodiment of the present invention.

FIG. 1 is a schematic configuration view of the image forming system 1.

As shown in FIG. 1, the image forming system 1 includes: an image forming apparatus 2 that forms an image on sheets; and a sheet feeding apparatus 3 that feeds the sheets to the image forming apparatus 2. Note that the exemplary embodiment will be explained on the assumption that corner-pasted envelopes P are stored in the sheet feeding apparatus 3 of the exemplary embodiment as sheets on which an image is formed.

[Image Forming Apparatus]

First, the image forming apparatus 2 will be explained.

The image forming apparatus 2 forms an image on sheets by using an electrophotographic system, and has: an apparatus body 201; a document conveying portion 210; an image reading portion 220; a sheet storing portion 230; an image forming portion 240; a fixing portion 250; a sheet conveying portion 260; and a not-shown control portion.

The apparatus body 201 is formed in a substantially rectangular parallelepiped box shape. Additionally, the image reading portion 220, the sheet storing portion 230, the image forming portion 240, the fixing portion 250, the sheet conveying portion 260, and the control portion are disposed inside the apparatus body 201, and the document conveying portion 210 is arranged at an upper portion of the apparatus body 201.

The document conveying portion 210 has a document feeding base 211 on which documents G are set; a plurality of rollers 212; a conveying drum 213; a conveying guide 214; a document ejecting roller 215; and a document receiving tray 216. The documents G set on the document feeding base 211 are conveyed to a reading position of the image reading portion 220 one by one by the plurality of rollers 212 and the conveying drum 213. The conveying guide 214 and the document ejecting roller 215 eject the documents G conveyed by the plurality of rollers 212 and the conveying drum 213 to the document receiving tray 216.

The image reading portion 220 reads an image of the document G conveyed by the document conveying portion 210 or an image of the document placed on a document base 221, and generates image data. An image of one surface of the document G conveyed to the image reading portion 220 or images of both surfaces thereof is (are) exposed by an optical system, and is (are) read by an image sensor 222.

In an image processing portion 223, various processing such as analog processing, A/D converting processing, shading correcting processing, and image compressing processing, is performed on an analog signal photoelectrically converted by the image sensor 222. The image signal on which various signal processing have been performed is then sent from the image processing portion 223 to the image forming portion 240.

Note that an image signal sent to the image forming portion 240 is not limited to the image signal output from the image reading portion 220, and may be received from an external apparatus such as a personal computer connected to the image forming apparatus 2, and other image forming apparatuses.

The sheet storing portion 230 is arranged at a lower portion of the apparatus body 201, and has a plurality of sheet feeding cassettes 231 provided in accordance with a size and a type of sheets S. The sheets S stored in the sheet feeding cassette 231 are each fed and sent to the sheet conveying portion 260, by the sheet feeding portion 232, and are each conveyed to a transfer portion 245 having a transferring position by the sheet conveying portion 260.

The image forming portion 240 and the fixing portion 250 are arranged between the image reading portion 220 and the sheet storing portion 230. The image forming portion 240 includes: a photoreceptor 241; a charging portion 242; an exposure portion 243; a development portion 244; the transfer portion 245, a cleaning portion 246, and the like.

The photoreceptor 241 is an image carrier, and rotates due to the drive by a not-shown driving source. The charging portion 242 uniformly charges a surface of the photoreceptor 241 by giving a charge to the photoreceptor 241. The exposure portion 243 forms an electrostatic latent image on the photoreceptor 241 by exposing the surface of the photoreceptor 241 on the basis of an image signal received from the image reading portion 220 or an image signal received from an external apparatus.

The development portion 244, for example, develops the electrostatic latent image formed on the photoreceptor 241 using a two-component developer including a toner and a carrier to thereby form a toner image. The transfer portion 245 transfers the toner image on the photoreceptor 241 to the sheet S conveyed by the sheet conveying portion 260 or the envelope P fed from the sheet feeding apparatus 3. The cleaning portion 246 removes toner remaining on the photoreceptor 241, i.e., cleans the surface of the photoreceptor 241.

The fixing portion 250 pressurizes and heats the sheet S or the envelope P to thereby fix the transferred toner image to the sheet S or the envelope P. The fixing portion 250, for example, has a fixing upper roller 251 and a fixing lower roller 252, which are a pair of fixing members. The fixing upper roller 251 and the fixing lower roller 252 are arranged in a pressure-contact state with each other, and a pressure-contact portion of the fixing upper roller 251 and the fixing lower roller 252 is a fixing nip portion that pressurizes and heats the sheet S or the envelope P.

A heating portion is provided inside the fixing upper roller 251. An outer circumference of the fixing upper roller 251 is warmed by radiant heat from the heating portion. Additionally, heat of the outer circumference of the fixing upper roller 251 is then transferred to the sheet S or the envelope P, and thereby the toner image on the sheet S or the envelope P is heat-fixed.

The sheet S or the envelope P is conveyed so that a surface (a fixing target surface) to which the toner image has been transferred by the transfer portion 245 faces the fixing upper roller 251, and passes through the fixing nip portion. Accordingly, pressurization by the fixing upper roller 251 and the fixing lower roller 252, and heating by the heat of the outer circumference of the fixing upper roller 251 are performed on the sheet S or the envelope P that passes through the fixing nip portion.

The sheet conveying portion 260 has a resist roller 262; a sheet ejecting portion 263; a conveying path switching portion 264; a sheet reversing and conveying portion 265; and a circulation refeeding portion 266. The sheet conveying portion 260 receives the envelope P fed from the sheet feeding apparatus 3.

The resist roller 262 corrects a bend of the sheet S or the envelope P with respect to a conveying direction, and also sends the sheet S or the envelope P to the transfer portion 245 in synchronization with rotation of the photoreceptor 241. The sheet ejecting portion 263 ejects, to an outside of the apparatus body 201, the sheet S or the envelope P to which the toner image has been fixed by the fixing portion 250.

The conveying path switching portion 264 is arranged closer to a downstream in a sheet conveying direction than the fixing portion 250. The conveying path switching portion 264 switches a conveying path of the sheet S or the envelope P that has passed through the fixing portion 250. Namely, the conveying path switching portion 264 makes the sheet S or the envelope P go straight, when the sheet S or the envelope P is ejected with the image side facing up, i.e., the sheet S or the envelope P is ejected with an image formation. surface in one-side image formation being directed upward. Thereby, the sheet S or the envelope P is ejected by the sheet ejecting portion 263. In addition, the conveying path switching portion 264 guides the sheet S or the envelope P downward, when the sheet S or the envelope P is ejected with the image side facing down, i.e., the sheet S or the envelope P is ejected with the image forming surface in the one-side image formation being directed downward, and when both-side image formation is performed.

When the sheet S or the envelope P is ejected with the image side facing up, the sheet S or the envelope P is guided downward by the conveying path switching portion 264, the front and back of the sheet S or the envelope P are subsequently inverted by the sheet reversing and conveying portion 265, and then the sheet or the envelope P is conveyed upward. Hereby, the sheet S or the envelope P in which the front and back are inverted and thereby the image forming surface faces downward is ejected by the sheet ejecting portion 263. When both-side image formation is performed, the sheet S or the envelope P is guided downward by the conveying path switching portion 264, the front and back of the sheet S or the envelope P are subsequently inverted by the sheet reversing and conveying portion 265, and the sheet S or the envelope P is sent to the transferring position again by the circulation refeeding portion 266.

[Sheet Feeding Apparatus]

Next, the sheet feeding apparatus 3 will be explained.

The sheet feeding apparatus 3 has: an apparatus body 301; and a plurality of sheet storing portions 302 provided according to a size and a type of the envelopes P. The apparatus body 301 is formed in a substantially rectangular parallelepiped box shape. The plurality of sheet storing portions 302 is disposed inside the apparatus body 301.

Additionally, the plurality of sheet storing portions 302 is disposed along a vertical direction of the apparatus body 301. The envelopes P stored in the sheet storing portion 302 are conveyed to the image forming apparatus 2 by a conveying portion 312 provided at the sheet storing portion 302. The sheet storing portion 302 is configured to be extractable from the apparatus body 301 by being moved along a not-shown guide rail.

[Sheet Storing Portion 302]

Next, a detailed configuration of the sheet storing portion 302 will be explained with reference to FIGS. 2 to 8.

Figure 2:
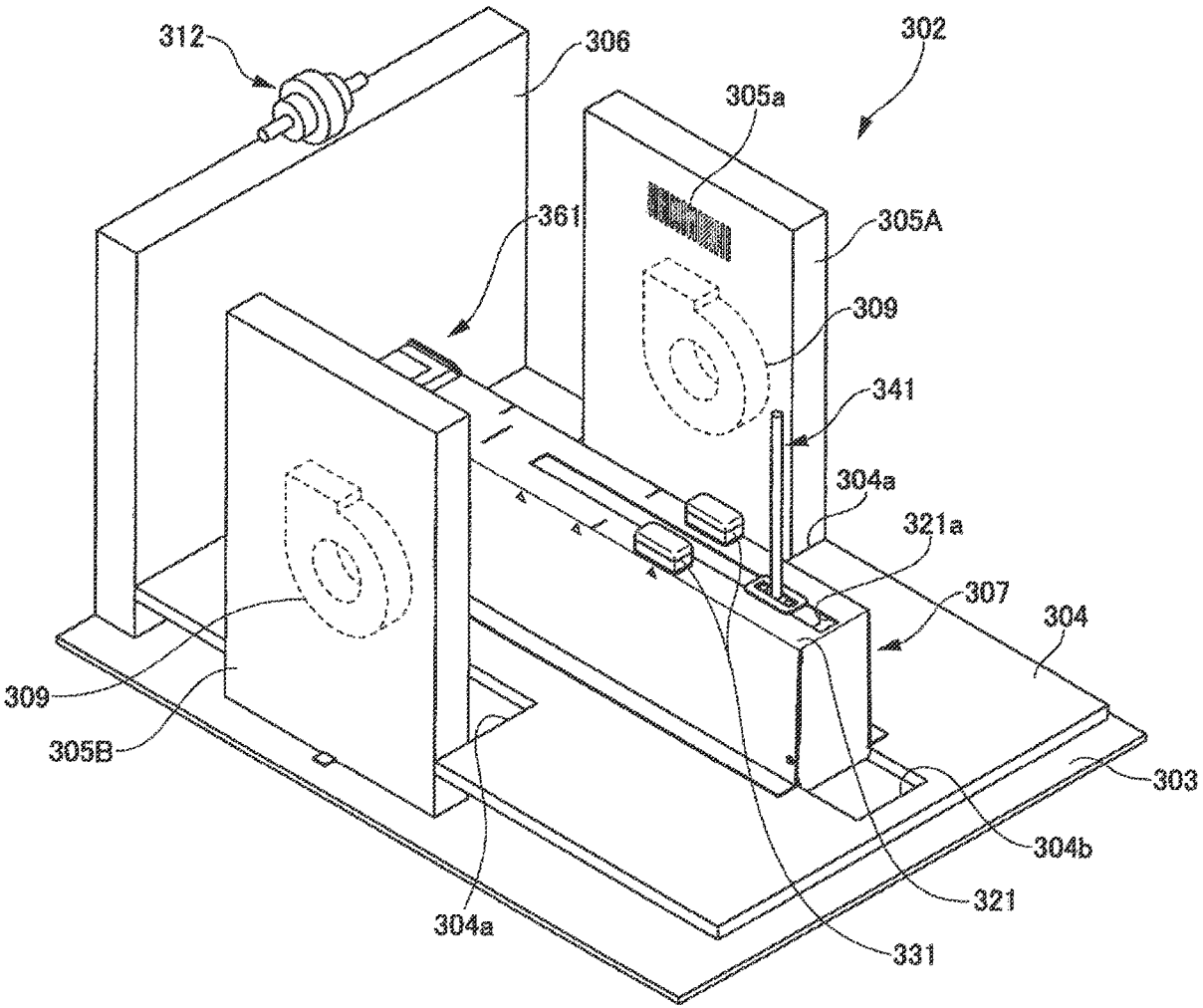
FIG. 2 is a perspective view showing a sheet storing portion in a sheet feeding apparatus according to the first exemplary embodiment of the present invention.
Figure 3:
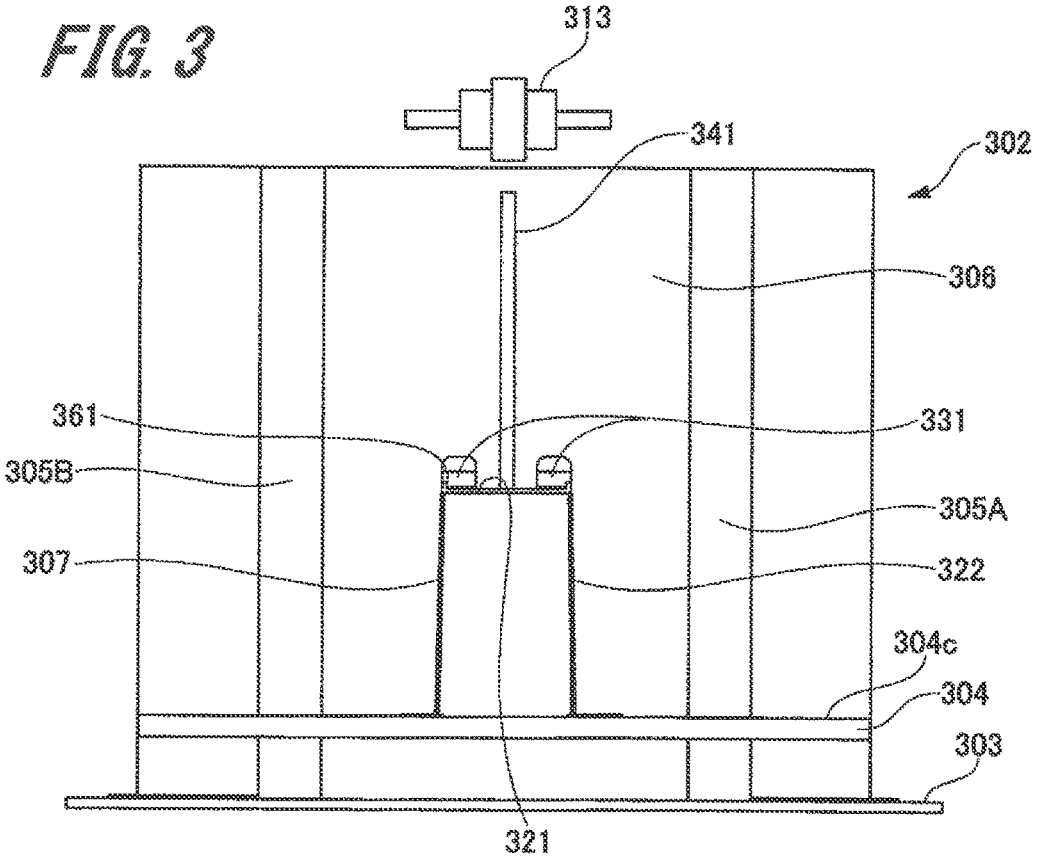
FIG. 3 is an elevational view showing the sheet storing portion in the sheet feeding apparatus according to the first exemplary embodiment of the present invention.

FIG. 2 is a perspective view showing the sheet storing portion 302, and FIG. 3 is an elevational view showing the sheet storing portion 302.

As shown in FIGS. 2 and 3, the sheet storing portion 302 has a supporting base 303; an elevating plate 304; two side restricting members 305A and 305B; a tip restricting member 306; a stacking base 307; a conveying portion 312; lifting members 331; a rear end restricting member 341; and a curve forming member 361. In addition, the sheet storing portion 302 has: an elevation driving portion 308 (refer to FIG. 9) that elevatably supports the elevating plate 304; an air blowing portion 309 that blows air to an upper portion of the envelopes P in the vertical direction, the envelopes P being stacked on the sheet storing portion 302; and a detecting sensor 310 (refer to FIG. 9). The two side restricting members 305A and 305B, the tip restricting member 306, and the elevation driving portion 308 are provided on one surface of the supporting base 303.

The elevating plate 304 showing one example of an elevating portion is elevatably supported by the elevation driving portion 308 (refer to FIG. 9) along the vertical direction. The elevating plate 304 is formed in a substantially rectangular plate shape. Respective notched portions 304*a* are formed on both sides of the elevating plate 304 in a width direction perpendicular to the conveying direction of the envelope P and also perpendicular to the vertical direction thereof. In addition, an inserting hole 304*b* that opens along the conveying direction is formed in a center of the elevating plate 304 in the width direction. Additionally, the side restricting members 305A and 305B are arranged in the notched portions 304*a*, and the stacking base 307 is arranged in the inserting hole 304*b*.

The two side restricting members 305A and 305B are arranged on both sides of the supporting base 303 in a width direction, and on a downstream side of the supporting base 303 in the conveying direction. The two side restricting members 305A and 305B are erected substantially perpendicular to the one surface of the supporting base 303. In addition, the two side restricting members 305A and 305B are supported by the supporting base 303 so as to be able to move in the width direction by the guide rail. The two side restricting members 305A and 305B are inserted in the notched portions 304*a* provided in the elevating plate 304. The interval between the two side restricting members 305A and 305B corresponds to a length of the envelopes P, in the width direction, stacked on the sheet storing portion 302. Additionally, the two side restricting members 305A and 305B restrict a position of the envelopes P in the width direction by slightly pressing the envelopes P from both sides of the envelopes P, in the width direction, stacked on the sheet storing portion 302.

The air blowing portions 309 are stored in the two side restricting members 305A and 305B, respectively. In addition, blowout ports 305*a* are formed at upper portions in the vertical direction in one surfaces facing to each other in the two side restricting members 305A and 305B, respectively. Air sent from the air blowing portions 309 is blown out of the blowout ports 305*a* (refer to FIG. 13). The air passes among the shets from one end portion of each of the envelopes P in the width direction, and is blown toward the other end of each of the envelopes P. The envelopes P are loosened by the air blow, and the upper envelopes P are separated one by one.

As shown in FIG. 2, the tip restricting member 306 is arranged on the downstream side of the supporting base 303 in the conveying direction. The tip restricting member 306 is erected perpendicularly from the supporting base 303. Additionally, the tip restricting member 306 restricts the end portions of the downstream side of the envelopes P, in the conveying direction, stored in the sheet storing portion 302. In addition, the conveying portion 312 is arranged at an upper portion of the tip restricting member 306 in the vertical direction.

Figure 4:
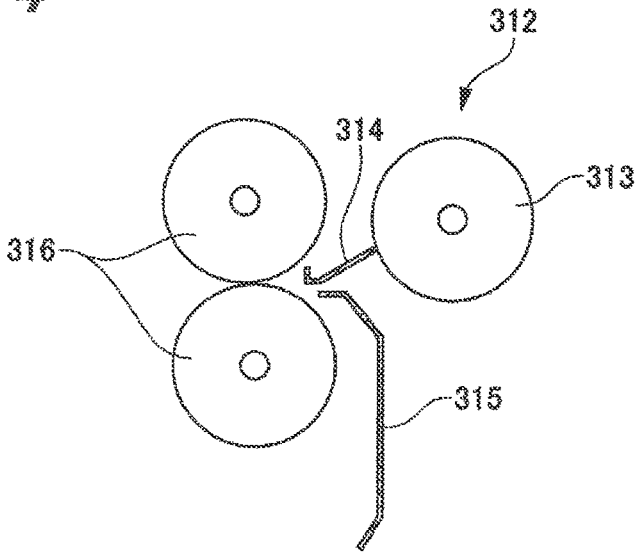
FIG. 4 is a cross-sectional view showing a conveying portion in the sheet feeding apparatus according to the first exemplary embodiment of the present invention.

FIG. 4 is a cross-sectional view showing the conveying portion 312.

The conveying portion 312 conveys an envelope located at the top of the envelopes P in the vertical direction (hereinafter, referred to as a topmost envelope) P1 to the image forming apparatus 2, the envelopes P being stored in the sheet storing portion 302. As shown in FIG. 4, the conveying portion 312 has: a sheet feeding roller 313; an upper guide 314; a lower guide 315; and a plurality of conveying rollers 316. The sheet feeding roller 313 abuts on an upper surface of the topmost envelope P1. In addition, the sheet feeding roller 313 is arranged upward in the vertical direction of an end portion of the downstream side of the stacking base 307, which will be described later, in the conveying direction.

The upper guide 314 and the lower guide 315 are arranged on the downstream side of the sheet feeding roller 313 in the conveying direction. The lower guide 315 is continuous with one surface of the tip restricting member 306 of the elevating plate 304 side. The upper guide 314 is arranged at an upper portion of the lower guide 315 in the vertical direction, with a predetermined interval. The upper guide 314 and the lower guide 315 guide the envelope P conveyed from the sheet feeding roller 313 to the pair of conveying rollers 316. The plurality of conveying rollers 316 then sends out the conveyed envelope P to the image forming apparatus 2 (refer to FIG. 1).

Next, the stacking base 307 will be explained.

Figure 5:
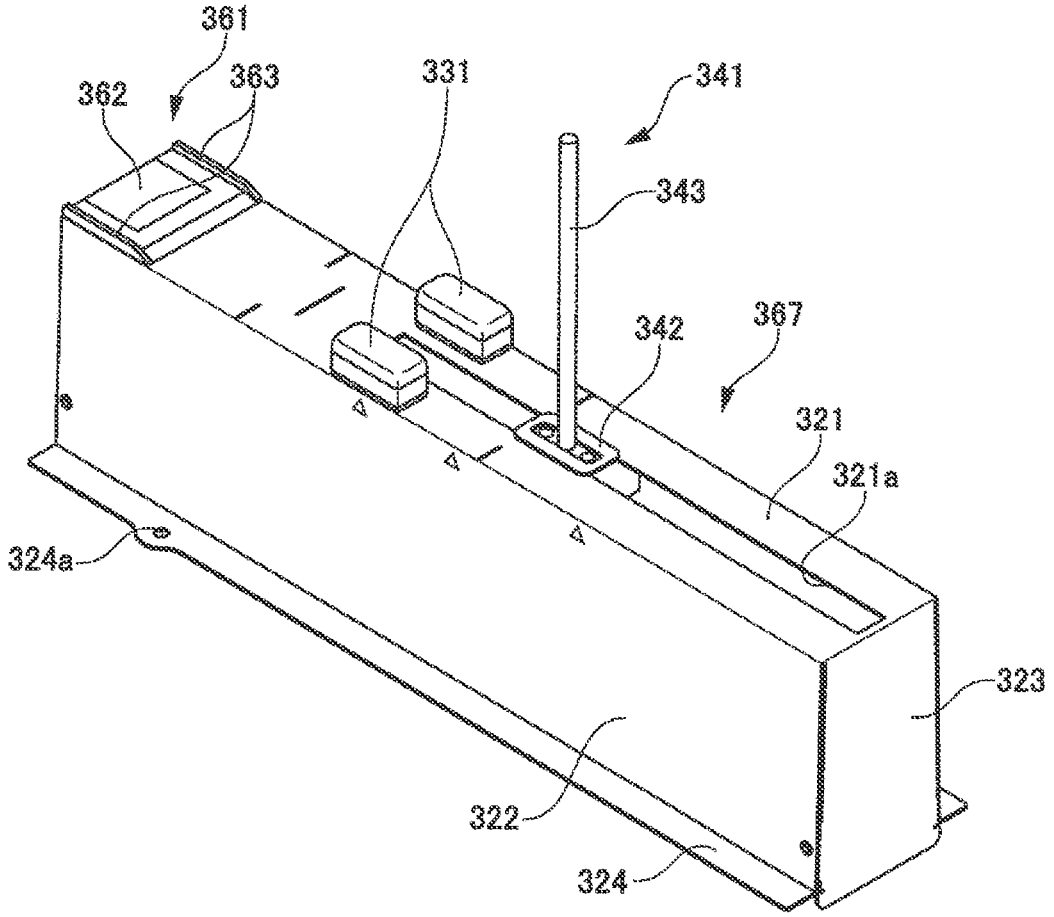
FIG. 5 is a perspective view showing a stacking base in the sheet feeding apparatus according to the first exemplary embodiment of the present invention.
Figure 6:
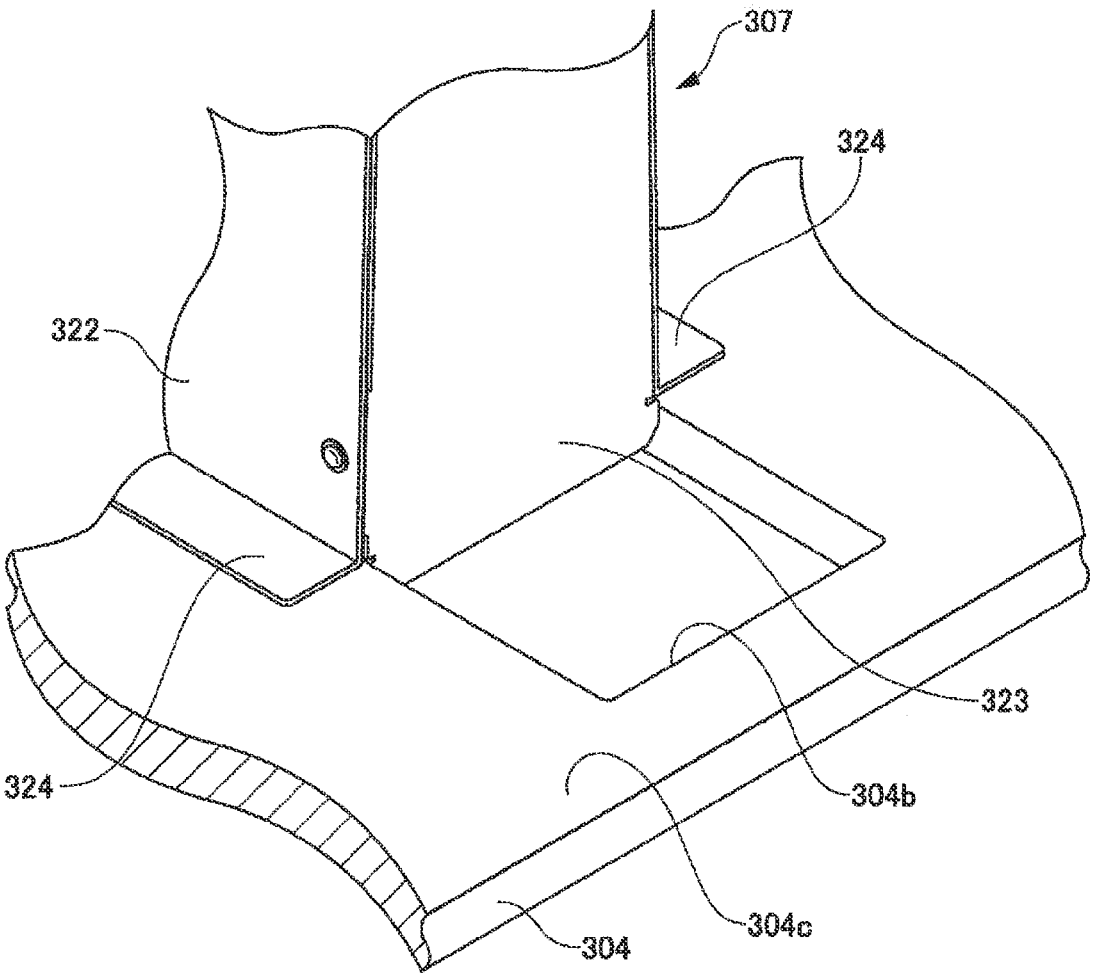
FIG. 6 is a perspective view showing a main portion of the stacking base and an elevating plate in the sheet feeding apparatus according to the first exemplary embodiment of the present invention.
Figure 7:
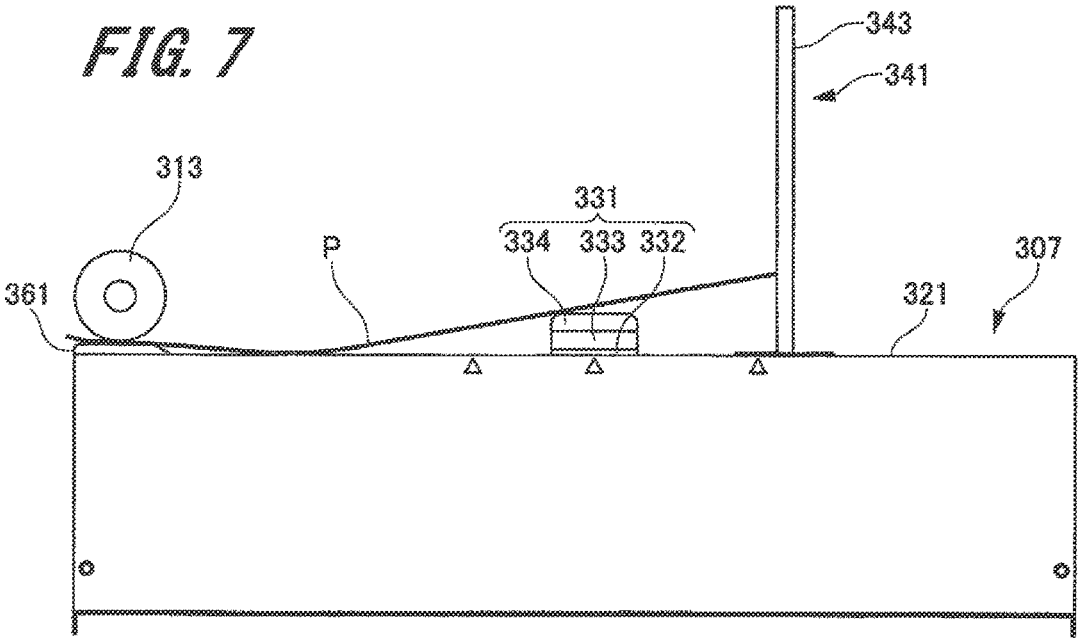
FIG. 7 is a side view showing the stacking base in the sheet feeding apparatus according to the first exemplary embodiment of the present invention.

FIG. 5 is a perspective view showing the stacking base 307, and FIG. 6 is a perspective view showing a main portion of an attaching portion of the stacking base 307 and the elevating plate 304. FIG. 7 is a side view showing the stacking base 307.

As shown in FIGS. 2 and 3, the stacking base 307 is detachably attached to an upper main surface portion 304*c* of the elevating plate 304 in the vertical direction.

In addition, as shown in FIG. 5, the stacking base 307 is formed in a hollow rectangular parallelepiped shape. The stacking base 307 has: a stacking surface portion 321 on which the envelopes P are stacked; two side surface portions 322 and 322; and a front surface portion 323. The stacking surface portion 321 is formed in a substantially rectangular shape. The two side surface portions 322 and 322 are substantially perpendicularly continuous from both end portions of the stacking surface portion 321 in the width direction. In addition, the front surface portion 323 is substantially perpendicularly continuous from an end portion of the upstream side of the stacking surface portion 321 in the conveying direction. The two side surface portions 322 and 322, and the front surface portion 323 project downward in the vertical direction from the stacking surface portion 321.

Outer flange portions 324 bent toward both sides in the width direction are formed at end portions of the two side surface portions 322 and 322, the end portions being located on the opposite side of the stacking surface portion 321, namely, at the end portions of the lower side in the vertical direction, respectively. As shown in FIG. 6, the outer flange portions 324 are placed on the main surface portion 304*c* of the elevating plate 304.

In addition, as shown in FIG. 5, fitting holes 324*a* are formed in the outer flange portions 324 of the two side surface portions 322 and 322 arranged on one sides of the two side surface portions 322 and 322 in the width direction, respectively. The fitting holes 324*a* are fitted to not-shown fitting pins provided at the elevating plate 304. Thereby, positioning of the stacking base 307 with respect to the elevating plate 304 in a conveying direction can be performed.

A length of the front surface portion 323 in the vertical direction is set to he longer than each length of the two side surface portions 322 and 322 in the vertical direction. In addition, as shown in FIG. 6, a lower end portion of the front surface portion 323 in the vertical direction is fitted to the inserting hole 304*b* provided in the elevating plate 304. Thereby, positioning of the stacking base 307 with respect to the elevating plate 304 in a width direction can be performed. As a result, the stacking base 307 is detachably attached substantially to the center of the elevating plate 304 in the width direction. Additionally, the stacking base 307 is elevated in the vertical direction integrally with the elevating plate 304.

Note that a method for attaching the stacking base 307 to the elevating plate 304 is not limited to the above-described method, and that other various attaching methods such as fixing screws and engaging pins can be used. Furthermore, the stacking base 307 may be fixed to the elevating plate 304.

In addition, a length of the stacking surface portion 321 in the width direction is set to be shorter than a length of the envelopes P to be stacked in the width direction. As shown in FIG. 3, when the stacking base 307 is attached to the elevating plate 304, the stacking surface portion 321 is arranged closer to the upper portion in the vertical direction than the main surface portion 304*c* of the elevating plate 304.

As shown in FIG. 5, a guiding groove 321*a* is formed in the center portion of the stacking surface portion 321 in the width direction along the conveying direction. The rear end restricting member 341, which will be described later, is slidably attached to the guiding groove 321*a*.

The rear end restricting member 341 has a slider 342; and a rear end restricting portion 343. The slider 342 is slidably supported by the guiding groove 321*a*. The rear end restricting portion 343 is formed in a rod shape. The rear end restricting portion 343 is erected from the slider 342 along the vertical direction.

As shown in FIG. 7, the rear end restricting portion 343 abuts on the upstream side of the envelopes P in the conveying direction, namely, rear ends of the envelopes P, the envelopes P being stacked on the stacking surface portion 321 of the stacking base 307. In addition, the slider 342 slides in the conveying direction along the guiding groove 321*a*, and thus the rear end restricting member 341 can change a position of the rear end restricting portion 343 with respect to the conveying direction according to a length of the envelopes P in the conveying direction.

Note that, although in the exemplary embodiment, there has been explained the example in which the rear end restricting portion 343 is formed in a rod shape, the present invention is not limited to this, and the rear end restricting portion 343 may be formed in other various shapes such as a flat-plate shape and a prismatic shape. In addition, although there has been explained the example in which the rear end restricting member 341 is provided at the stacking base 307, the present invention is not limited to this, and a rear end restricting member may be provided at a side restricting member.

As shown in FIG. 5, the pair of lifting members 331 are detachably attached to the stacking surface portion 321. As shown in FIG. 7, the pair of lifting members 331 are arranged near the rear end restricting member 341 and closer to the downstream side in the conveying direction than the rear end restricting member 341.

The lifting member 331 is formed in a substantially rectangular parallelepiped shape. The lifting member 331 has a magnetic surface portion 332 attracted to the stacking surface portion 321 by a magnetic force; an elastic portion 333; and a supporting portion 334. The elastic portion 333 is formed between the magnetic surface portion 332 and the supporting portion 334. Other various members having elasticity, such as foamed urethane, rubber, and a coil spring are applied to the elastic portion 333.

The lifting members 331 lift a predetermined position of the envelopes P stacked on the stacking surface portion 321, and thus the end portions of the upstream side of the envelopes P in the conveying direction are lifted upward in the vertical direction. In addition, the end portions of the downstream side of the envelopes P in the conveying direction are pressed to the stacking surface portion 321 side by the sheet feeding roller 313, and are kept substantially horizontal. Therefore, the envelopes P are curved in the conveying direction, i.e., in a longitudinal direction, by the lifting members 331. Namely, the lifting members 331 impart a corrugation to the envelopes P in the longitudinal direction.

Note that, although there has been explained the example in which the lifting members 331 are provided in the sheet feeding apparatus 3 of the exemplary embodiment, the present invention is not limited to this, and an object of the present invention can be achieved even if the lifting members 331 are not provided.

In addition, as shown in FIG. 5, the curve forming member 361 is provided at an end portion of the downstream side of the stacking surface portion 321 in the stacking base 307 in the conveying direction.

Figure 8:
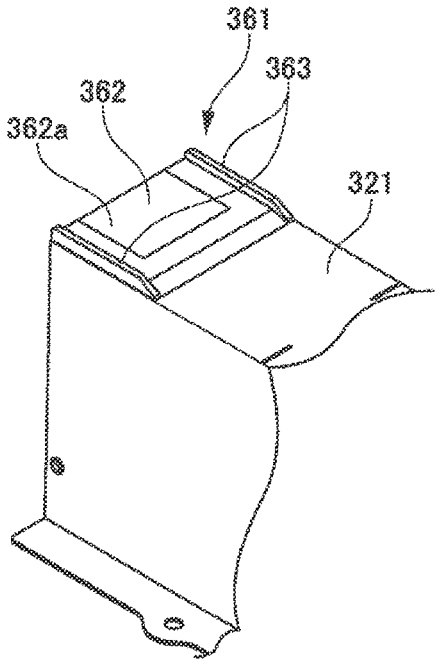
FIG. 8 is a perspective view showing a lifting member in the sheet feeding apparatus according to the first exemplary embodiment of the present invention.

FIG. 8 is a perspective view showing the curve forming member 361.

As shown in FIG. 8, the curve forming member 361 has a plate-shaped pressing surface portion 362; and a pair of projections 363 showing one example of a curve forming portion. The pressing surface portion 362 is detachably attached to the end portion of the downstream side of the stacking surface portion 321 in the conveying direction. The pressing surface portion 362 faces the sheet feeding roller 313 of the conveying portion 312 in the vertical direction (refer to FIG. 11B). The pressing surface portion 362 is pressed from the upper portion in the vertical direction by the sheet feeding roller 313 via the envelopes P.

A nonslip portion 362*a* is provided at a portion, in the pressing surface portion 362, pressed by the sheet feeding roller 313 via the envelopes P. Thereby, the envelopes P can be prevented from slipping on the pressing surface portion 362 at the time of sheet feeding of the sheet feeding roller 313. In addition, length of the pressing surface portion 362 in a width direction is set to be longer than a length of a contact surface of the sheet feeding roller 313 in a width direction, the contact surface coming into contact with the envelope P (refer to FIG. 11B). The pair of projections 363 are provided at both end portions of the pressing surface portion 362 in the width direction.

The pair of projections 363 project upward in the vertical direction from the both end portions of the pressing surface portion 362 in the width direction. In addition, the pair of projections 363 are arranged at both sides of the sheet feeding roller 313 in the width direction. The pair of projections 363 lift both end portions of the envelopes in the width direction, stacked on the stacking surface portion 321, upward in the vertical direction (refer to FIG. 11B).

Furthermore, although in the exemplary embodiment, there has been explained example in which the stacking base 307 is detachably attached to the elevating plate 304, the present invention is not limited to this. For example, in the case of a sheet storing portion that exclusively stores the envelopes P, the elevating plate 304 and the stacking base 307 may be integrally formed.

In addition, although there has been explained example in which the curve forming member 361 is detachably attached to the stacking base 307, the curve forming member 361 may be fixed to the stacking base 307.

[Configuration of Control System]

Next, a configuration of a control system of the sheet feeding apparatus 3 will be explained with reference to FIG. 9.

Figure 9:
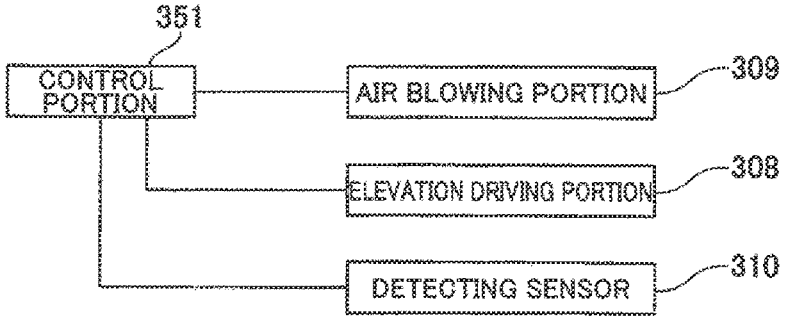
FIG. 9 is a block diagram showing a configuration of a control system of the sheet feeding apparatus according to the first exemplary embodiment of the present invention.

FIG. 9 is a block diagram showing the configuration of the control system of the sheet feeding apparatus 3.

As shown in FIG. 9, the sheet feeding apparatus 3 includes a control portion 351. The control portion 351 has: for example, a CPU (Central Processing Unit); a ROM (Read Only Memory) for storing a program etc. executed by the CPU; and a RAM (Random Access Memory) used as a workspace of the CPU. Furthermore, the air blowing portions 309, the elevation driving portion 308, and the detecting sensor 310 are connected to the control portion 351; and the control portion 351 achieves functions of the sheet feeding apparatus 3 by control of the air blowing portions 309, the elevation driving portion 308, and the detecting sensor 310.

The detecting sensor 310 detects a height of the envelopes P stacked on the stacking surface portion 321 in the sheet storing portion 302. Additionally, height information of the envelopes P detected by the detecting sensor 310 is transmitted to the control portion 351.

The elevation driving portion 308 elevates the elevating plate 304 and the stacking base 307 on the basis of a signal transmitted from the control portion 351. In addition, the air blowing portions are driven on the basis of the signal transmitted from the control portion 351, and adjust air quantities to be blown out.

Note that, although in the exemplary embodiment, there has been explained the example in which the control portion 351 is provided in the sheet feeding apparatus 3, the present invention is not limited to this. For example, the air blowing portions 309 and the elevation driving portion 308 may be driven by a control portion provided in the image forming apparatus 2 without being provided in the sheet feeding apparatus 3, and information detected by the detecting sensor 310 may be transmitted to the control portion provided in the image forming apparatus 2.

[Comparison of Conventional Example and the Exemplary Embodiment]

Next, comparison between the sheet feeding apparatus 3 of the exemplary embodiment and a conventional sheet feeding apparatus will be explained with reference to FIGS. 10 to 11.

Figure 10A:
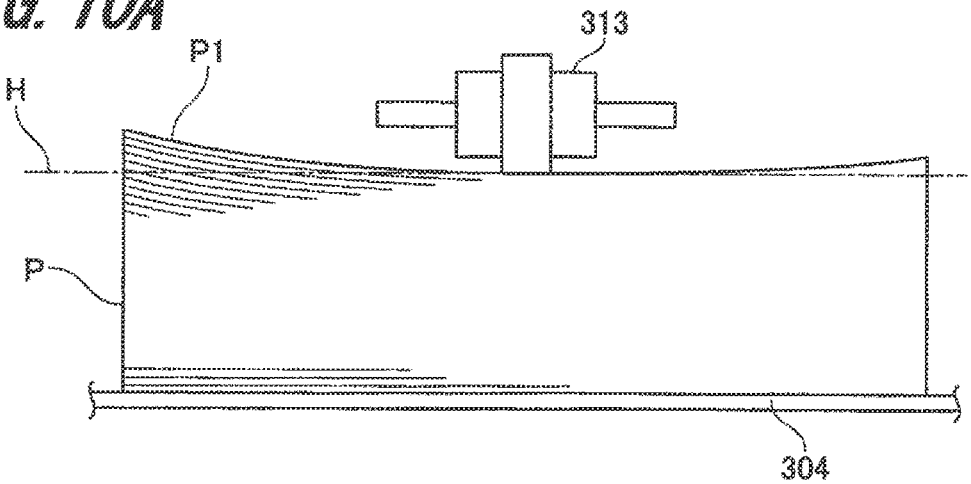
FIGS. 10A and 10B are views each showing a state where envelopes are stacked on a sheet feeding apparatus.
Figure 10B:
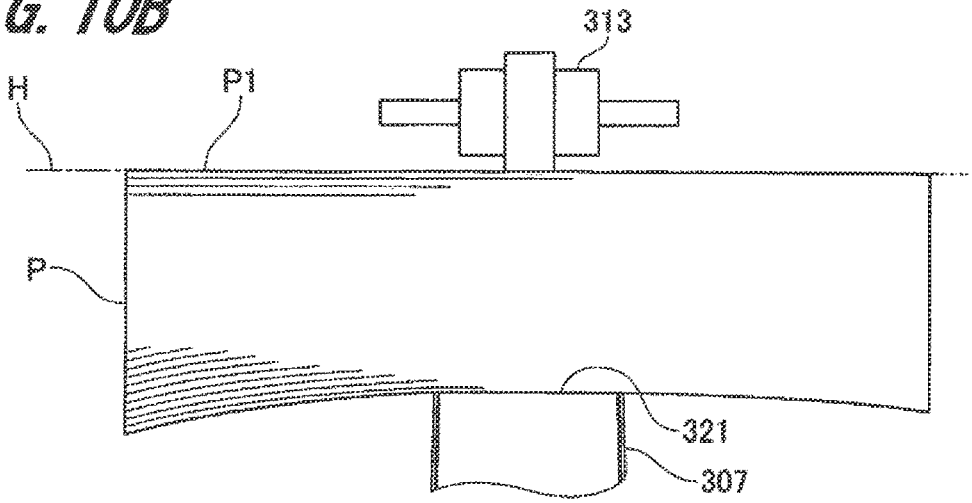

FIGS. 10A and 10B are elevational views each showing a state where the envelopes P are stacked on the sheet feeding apparatus. FIG. 10A shows the conventional sheet feeding apparatus, and FIG. 10B shows the sheet feeding apparatus 3 of the exemplary embodiment.

As shown in FIG. 10A, the envelopes P are stacked on the elevating plate 304 in the conventional sheet feeding apparatus. Here, since a pasted portion is formed on one side of the corner-pasted envelope P in the width direction, the one side in the width direction becomes thicker than the other side. Therefore, when the envelopes P are stacked on the elevating plate 304, the one side in the width direction becomes higher than the other side, and one surface of the topmost envelope P1 inclines with respect to a horizontal surface H. As a result, when the topmost envelope 91 is conveyed from the sheet feeding roller 313 to the upper guide 314 and the lower guide 315 (refer to FIG. 4), the topmost envelope P1 is not inserted between the upper guide 314 and the lower guide 315, and thus paper jamming may occur.

In contrast to this, in the sheet feeding apparatus 3 of the exemplary embodiment, the stacking base 307 is provided at the elevating plate 304, and the envelopes Pare stacked on the stacking surface portion 321. As shown in FIG. 10B, a length of the stacking surface portion 321 in the width direction is set to be shorter than the length of the envelopes P in the width direction. Furthermore, the stacking surface portion 321 is arranged substantially at the center portion of the envelopes P in the width direction.

Therefore, both end portions of the envelopes P in the width direction, stacked on the stacking surface portion 321, project toward both sides in the width direction from the stacking surface portion 321. Namely, the both end portions of the envelopes P in the width direction are brought into a state of floating up since they are supported by nothing from the lower portion in the vertical direction. Additionally, the envelopes P stacked on the stacking surface portion 321 droop downward in the vertical direction due to their own weight.

Thereby, the one surface of the topmost envelope P1 can be corrected substantially in parallel with the horizontal surface H, and a horizontal posture of the topmost envelope P1 can be favorably maintained. As a result, when the topmost envelope P1 is conveyed to the upper guide 314 and the lower guide 315 by the sheet feeding roller 313, the topmost envelope P1 can be smoothly inserted between the upper guide 314 and the lower guide 315.

Figure 11A:
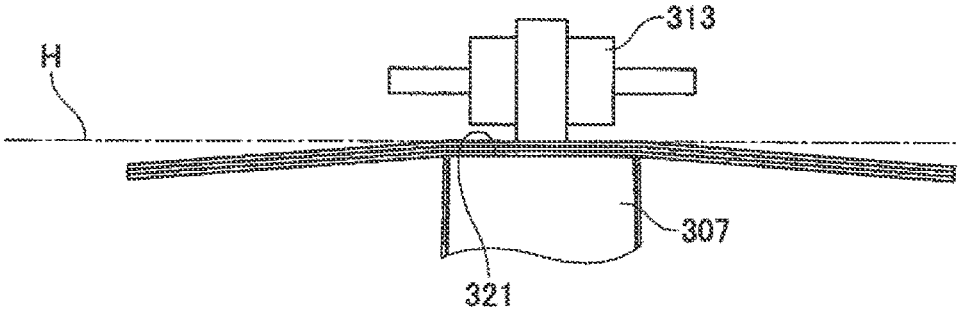
FIGS. 11A and 11B are views each showing a state were the number of stacked envelopes is decreased.
Figure 11B:
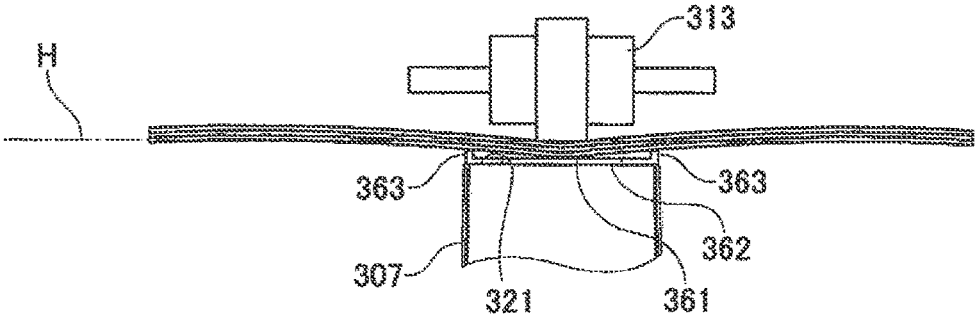

FIGS. 11A and 11B are elevational views each showing a state where the number of stacked envelopes P stacked on the stacking surface portion 321 is decreased. FIG. 11A shows an example where the curve forming member 361 is not provided, and FIG. 11B shows an example where the curve forming member 361 is provided.

As shown in FIG. 11A, the both end portions of the envelopes P in the width direction are supported by nothing from the lower portion in the vertical direction. Therefore, since the both end portions of the envelopes P in the width direction are in a state of drooping from both sides of the stacking surface portion 321 in the width direction, and in a state of floating up, both end portions of the one surface of the topmost envelope P1 in the width direction also droop downward in the vertical direction with respect to the horizontal surface H.

In contrast to this, in the sheet feeding apparatus of the exemplary embodiment, the lifting members 331 are provided on the upstream side of the envelopes P in the conveying direction. Therefore, as shown in FIG. 7, the end portions of the upstream side of the envelopes P in the conveying direction are lifted upward in the vertical direction by the lifting members 331. In addition, the end portions of the downstream side of the envelopes P in the conveying direction are pressed to the stacking surface portion 321 side by the sheet feeding roller 313, and are kept substantially horizontal. Therefore, the envelopes P are curved in the conveying direction, i.e., in the longitudinal direction, by the lifting members 331. Namely, the lifting members 331 impart a corrugation to the envelopes P in the longitudinal direction. Thereby, the corrugation in the longitudinal direction is imparted to the envelopes P, and thus drooping of the both end portions of the envelopes P in the width direction are suppressed.

However, as shown in FIG. 11A, in the case of the envelopes P with low rigidity, even if the corrugation in the longitudinal direction is imparted, an effect thereof becomes small. Therefore, the both end portions of the downstream side of the envelopes P in the conveying direction droop downward in the vertical direction.

In contrast to this, in the sheet feeding apparatus 3 of the exemplary embodiment, the curve forming member 361 is provided at a portion that faces the sheet feeding roller 313 on the downstream side of the envelopes P in the conveying direction. As shown in FIG. 11B, the pair of projections 363 and 363 of the curve forming member 361 lift the envelopes P upward in the vertical direction from the both sides of the sheet feeding roller 313 in the width direction.

Therefore, the end portions of the downstream side of the envelopes P in the conveying direction are curved so that a lower portion of the envelopes P in the vertical direction is protruded along the width direction by the sheet feeding roller 313, and the pair of projections 363 and 363 of the curve forming member 361. Thereby, drooping of the both end portions of the envelopes P in the width direction are suppressed. As a result, even if the number of stacked envelopes P is decreased, the one surface of the topmost envelope P1 can be maintained substantially in parallel with the horizontal surface H.

Note that a projection height of the pair of projections 363 and 363 is appropriately set in accordance with the interval formed between the upper guide 314 and the lower guide 315, and rigidity of the envelopes P.

As described above, according to the sheet feeding apparatus 3 of the exemplary embodiment, the posture of the stored envelopes P can be horizontally maintained by a simple configuration of the stacking surface portion 321 and the curve forming member 361.

[Operation of Air Blowing Portion]

Next, an operation of the air blowing portions 309 in the sheet feeding apparatus 3 of the exemplary embodiment will be explained with reference to FIGS. 12 to 15.

FIG, 12 is a flow chart showing one example of the operation of the air blowing portions 309. The CPU of the control portion 351 executes a program stored in the ROM to thereby control the air blowing portions 309, and thus the sheet feeding apparatus 3 achieves processing shown in the flow chart of FIG. 12. FIGS. 12 to 15 are explanatory views each showing a state of air blown to the envelopes P.

Figure 12:
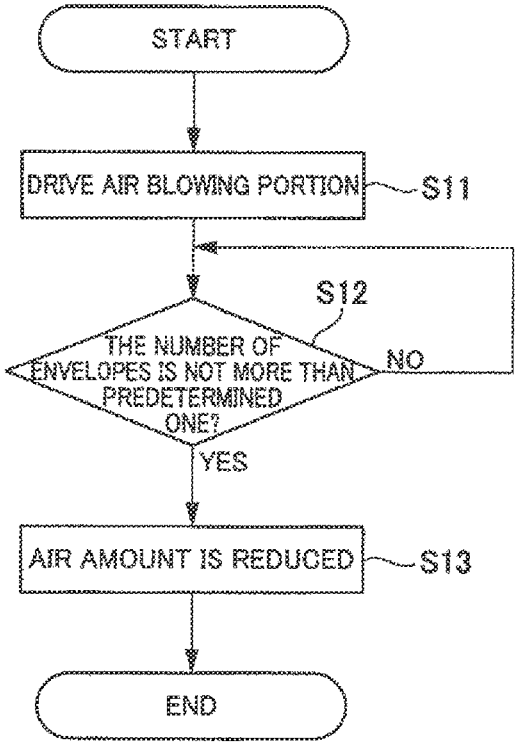
FIG. 12 is a flow chart showing an operation of an air blowing portion in the sheet feeding apparatus according to the first exemplary embodiment of the present invention.
Figure 13:
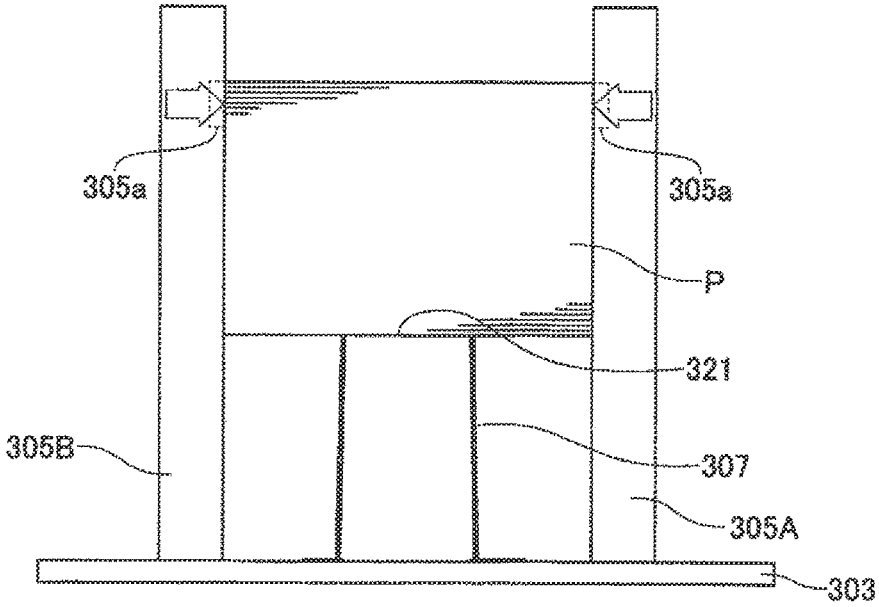
FIG. 13 is an explanatory view showing an operation of the air blowing portion in a state where envelopes are stacked on the sheet feeding apparatus according to the first exemplary embodiment of the present invention.

First, as shown in FIG. 12, the control portion 351 drives the air blowing portions 309 (step S11). Therefore, as shown in FIG. 13, air is blown to the upper envelopes P in the vertical direction in the envelopes P stacked on the stacking surface portion 321, from the blowout ports 305*a* arranged on both sides in the width direction. Thereby, the envelopes P are loosened, the upper envelopes P are separated one by one, and the one surface of the topmost envelope P1 can be made substantially horizontal.

Figure 14:
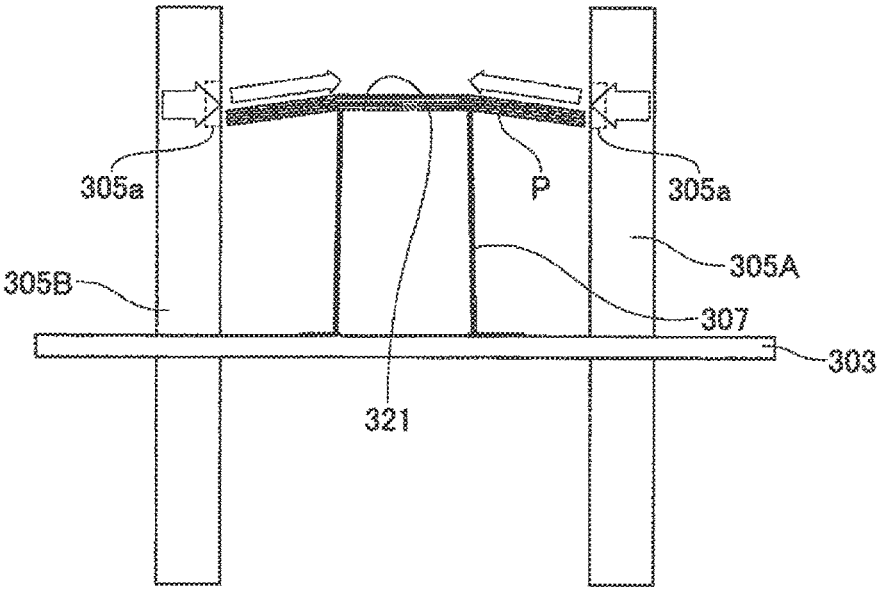
FIG. 14 is an explanatory view showing an operation of the air blowing portion in a state where the envelopes are stacked on the sheet feeding apparatus according to the first exemplary embodiment of the present invention.

Here, as shown in FIG. 14, the both end portions of the envelopes P in the width direction are supported by nothing from the lower portion in the vertical direction, in the sheet feeding apparatus 3 of the exemplary embodiment. Therefore, when air is blown to the both end portions of the envelopes P in the width direction from the blowout ports 305*a* in a state where the number of stacked envelopes P is decreased, the air blows through the upper portion of the envelopes P in the vertical direction. As a result, the both end portions of the envelopes P in the width direction are pressed downward in the vertical direction, by the air.

Therefore, as shown in FIG. 12, the control portion 351 determines whether or not the number of envelopes P stacked on the stacking surface portion 321 is not more than the predetermined number on the basis of information from the detecting sensor 310 (step S12). In step S12, when a determination is made that the number of stacked envelopes P is more than the predetermined number (NO determination of step S12), the control portion 351 maintains air quantities by the air blowing portions 309.

In addition, in step 812, when a determination is made that the number of stacked envelopes P is not more than the predetermined number (YES determination of step 812), the control portion 351 controls the air blowing portions 309 to thereby reduce the air quantities (step S13).

Figure 15:
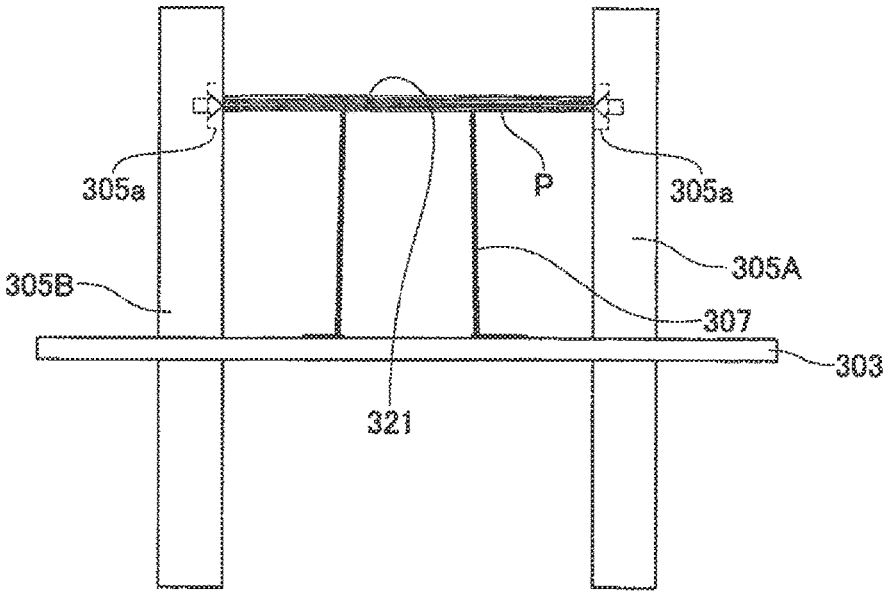
FIG. 15 is an explanatory view showing an operation of the air blowing portion in a state where the envelopes are stacked on the sheet feeding apparatus according to the first exemplary embodiment of the present invention.

As shown in FIG. 15, the air quantities blown out of the blowout ports 305*a* are reduced, and thus the both end portions of the envelopes P in the width direction can be prevented from being pressed downward in the vertical direction by the air, even when the number of stacked envelopes P is decreased. Note that, although in the exemplary embodiment, there has been explained the example in which the air quantities are reduced, the present invention is not limited to this, and drive of the air blowing portions 309 may be stopped when the number of stacked envelopes P becomes not more than the predetermined number.

2. Second Exemplary Embodiment

Next, a sheet feeding apparatus according a second exemplary embodiment of the present invention will be explained with reference to FIG. 16.

Figure 16:
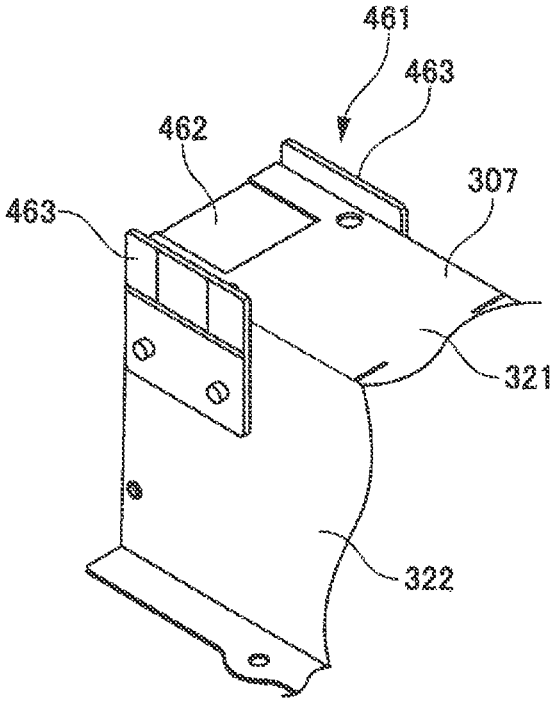
FIG. 16 is a perspective view showing a curve forming member in a sheet feeding apparatus according to a second exemplary embodiment of the present invention.

FIG. 16 is a perspective view showing a stacking base of the sheet feeding apparatus according to the second exemplary embodiment.

A point in which the sheet feeding apparatus according to the second exemplary embodiment differs from the sheet feeding apparatus 3 according to the first exemplary embodiment is a configuration of a curve forming member. Therefore, the curve forming member will be explained here, and the same symbols are attached to portions in common with the sheet feeding apparatus 3 according to the first exemplary embodiment; and overlapping explanation thereof is omitted.

As shown in FIG. 16, a curve forming member 461 is formed at the end portion of the downstream side of the stacking base 307 in the conveying direction. The curve forming member 461 has a pressing surface portion 462; and a pair of projecting pieces 463 showing one example of a curve forming portion.

The pressing surface portion 462 is formed at the end portion of the downstream side of the stacking surface portion 321 in the conveying direction. Namely, in the curve forming member 461 according to the second exemplary embodiment, the pressing surface portion 462 and the stacking surface portion 321 are integrally configured.

The pair of projecting pieces 463 are each formed in a flat-plate shape. The pair of projecting pieces 463 are fixed to the side surfaces 322 of the stacking base 307, respectively. Additionally, upper end portions of the pair of projecting pieces 463 in the vertical direction project more upward than the pressing surface portion 462 formed on the stacking surface portion 321.

Since other configurations are similar to those of the sheet feeding apparatus 3 according to the above-described first exemplary embodiment, explanation thereof is omitted. Actions and effects similar to those of the sheet feeding apparatus 3 according to the above-described first exemplary embodiment can be obtained also by the sheet feeding apparatus having the curve forming member 461 having such a configuration.

3. Third Exemplary Embodiment

Next, a sheet feeding apparatus according to a third exemplary embodiment of the present invention will be explained with reference to FIGS. 17A to 17C.

Figure 17A:
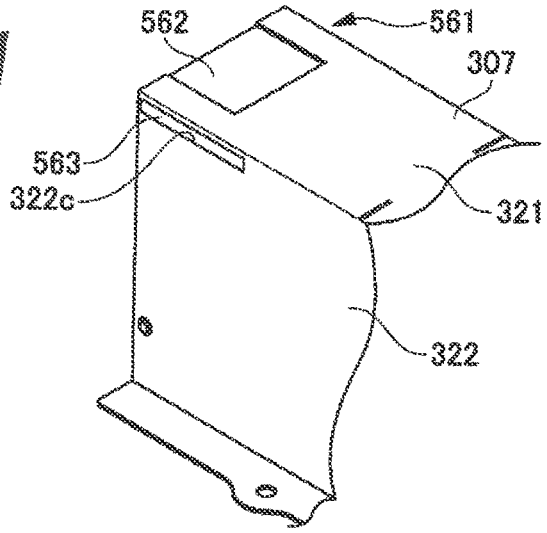
FIGS. 17A to 17C are views each showing a curve forming member in a sheet feeding apparatus according to a third exemplary embodiment of the present invention.
Figure 17B:
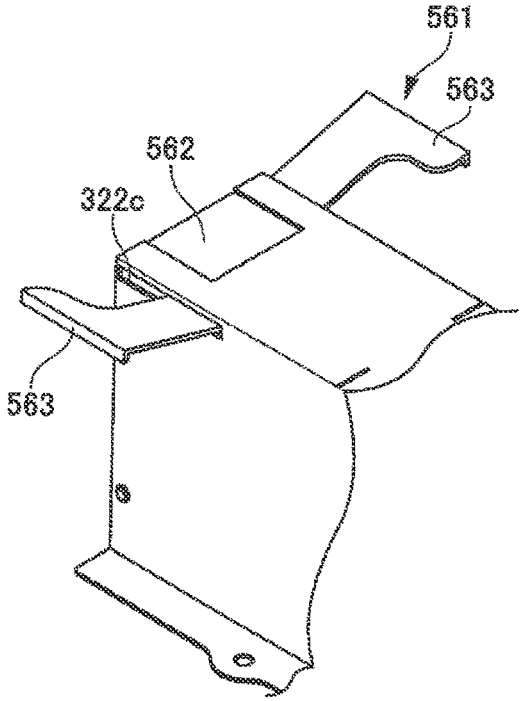
Figure 17C:
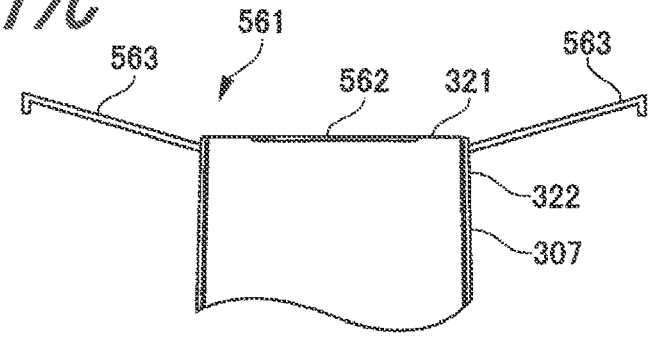

FIGS. 17A to 17C are explanatory views each showing a main portion of the sheet feeding apparatus according to the third exemplary embodiment.

A point in which the sheet feeding apparatus according to the third exemplary embodiment differs from the sheet feeding apparatus 3 according to the first exemplary embodiment is a configuration of a curve forming member. Therefore, here, the curve forming member will be explained here, the same symbols are attached to portions in common with the sheet feeding apparatus 3 according to the first exemplary embodiment, and overlapping explanation thereof is omitted.

As shown in FIG. 17A, a curve forming member 561 is formed at the end portion of the downstream side of the stacking base 307 in the conveying direction. The curve forming member 561 has: a pressing surface portion 562; and a pair of projecting pieces 563 and 563 showing one example of a curve forming portion. Since the pressing surface portion 562 is the same as the pressing surface portion. 462 according to the second exemplary embodiment, explanation thereof is omitted.

In addition, housing holes 322*c* are each formed on the downstream side of the side surfaces 322 of the stacking base 307 in the conveying direction, and at upper ends thereof in the vertical direction. The projecting pieces 563 are housed in the housing holes 322*c*.

As shown in FIGS. 17B and 17C, the projecting pieces 563 project toward both sides in the width direction from the housing holes 322*c*. The projecting pieces 563 are each formed of a flat spring having elasticity. Additionally, when the projecting pieces 563 project toward the both sides in the width direction from the housing holes 322*c*, tips thereof project more upward in the vertical direction than the pressing surface portion 562.

Since other configurations are similar to those of the sheet feeding apparatus 3 according to the above-described first exemplary embodiment, explanation thereof is omitted. Actions and effects similar to those of the sheet feeding apparatus 3 according to the above-described first exemplary embodiment can be obtained also by the sheet feeding apparatus with the curve forming member 561 having such a configuration.

In addition, in the curve forming member 561 according to the third exemplary embodiment, the projecting pieces 553 are each formed of the flat spring. Therefore, when a number of envelopes P are stacked on the stacking surface portion 321, the projecting pieces 563 are biased downward in the vertical direction. When the number of stacked envelopes P is then decreased, a load applied to the projecting pieces 563 becomes smaller, and thus the projecting pieces 563 are elastically deformed upward in the vertical direction.

Thereby, a height of the projecting pieces 563 with respect to the vertical direction can be changed in accordance with the stacked number of envelopes P, the projecting pieces 563 supporting the both end portions of the downstream side of the envelopes in the conveying direction. As a result, a radius of curvature of curves in the width direction in the end portions of the downstream side of the envelopes P in the conveying direction can be changed in accordance with the stacked number of envelopes P.

In addition, in the curve forming member 561 according to the third exemplary embodiment, the projecting pieces 563 are configured to be able to be housed in the stacking base 307. Therefore, when rigidity of the envelopes P is high, and a droop amount in the both end portions of the envelopes P in the width direction is small even though the number of stacked envelopes P is decreased, the projecting pieces 563 can be housed in the stacking base 307.

4. Fourth Exemplary Embodiment

Next, a sheet feeding apparatus according to a fourth exemplary embodiment will be explained with reference to FIGS. 18A and 18B.

Figure 18A:
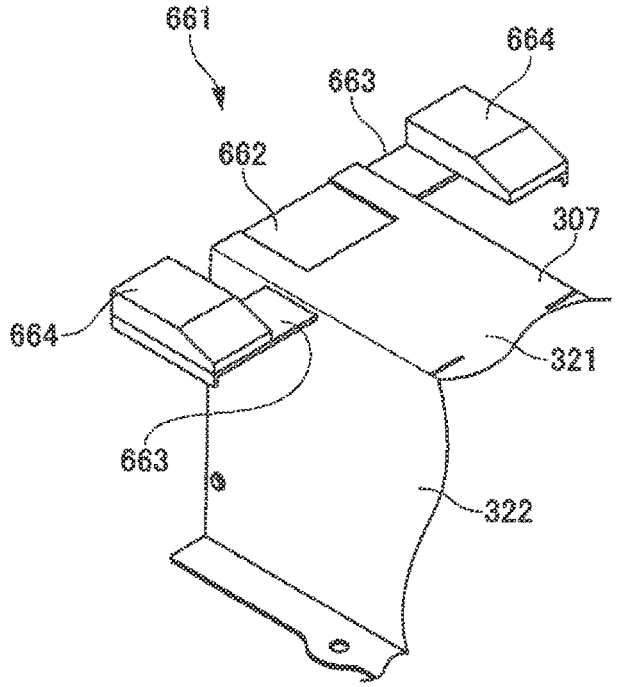
FIGS. 18A and 18B are views each showing a curve forming member in a sheet feeding apparatus according to a fourth exemplary embodiment of the present invention.
Figure 18B:
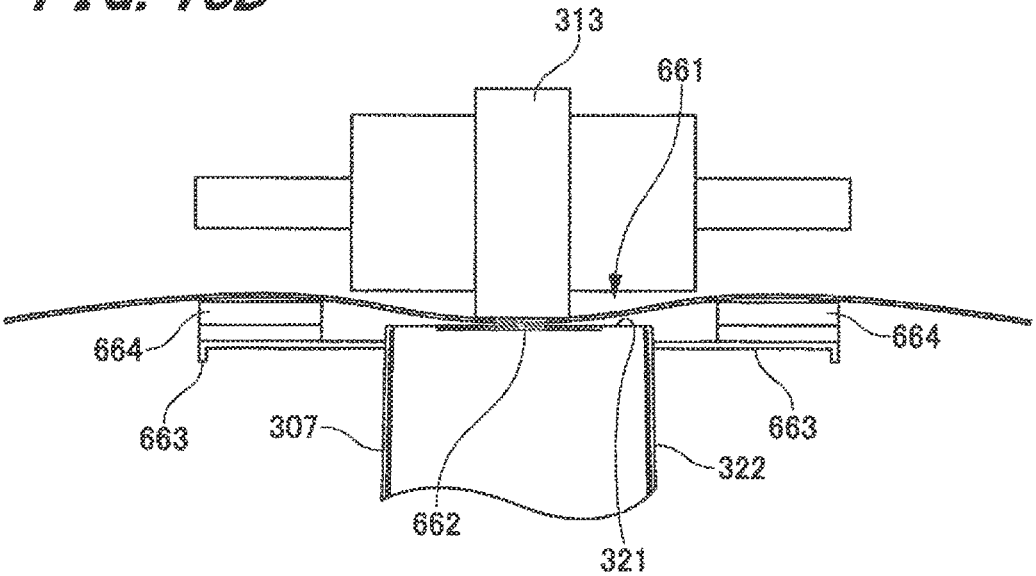

FIGS. 18A and 18B are explanatory views each showing a main portion of the sheet feeding apparatus according to the fourth exemplary embodiment.

A point where the sheet feeding apparatus according to the fourth exemplary embodiment differs from the sheet feeding apparatus 3 according to the first exemplary embodiment is a configuration of a curve forming member. Therefore, the curve forming member will be explained here, the same symbols are attached to portions in common with the sheet feeding apparatus 3 according to the first exemplary embodiment, and overlapping explanation thereof is omitted.

As shown in FIGS. 18A and 18B, a curve forming member 661 is formed at the end portion of the downstream side of the stacking base 307 in the conveying direction. The curve forming member 661 has: a pressing surface portion 662; and a pair of supporting plates 663 and 663. Since the pressing surface portion 662 is the same as the pressing surface portion 462 according to the second exemplary embodiment, explanation thereof is omitted.

The pair of supporting plates 663 and 663 project substantially in parallel with a horizontal direction toward both sides in the width direction from the downstream side of the side surfaces 322 of the stacking base 307 in the conveying direction, and from upper ends thereof in the vertical direction. In addition, supporting projections 664 showing one example of a curve forming portion are provided on upper surface portions of the supporting plates 663 in the vertical direction.

The supporting projections 664 are each formed in a substantially rectangular parallelepiped shape having an inclined surface on the upstream side in the conveying direction. The supporting projections 664 are each formed of a member having elasticity, for example, formed of foamed urethane.

Note that, although there has been explained the example in which the supporting projections 664 are each formed of the member having elasticity, the present invention is not limited to this, and the supporting projections 664 may be each formed of a member without elasticity.

The both end portions of the envelopes P in the width direction more largely droop downward in the vertical direction as they are separated from the pressing surface portion 662. Therefore, it is preferable that a height of the supporting projections 664 in the vertical direction is made smaller as the supporting projections 664 come close to the sheet feeding roller 313, and is made larger as they are separated from the sheet feeding roller 313.

Since other configurations are similar to those of the sheet feeding apparatus 3 according to the above-described first exemplary embodiment, explanation thereof is omitted. Actions and effects similar to those of the sheet feeding apparatus 3 according to the above-described first exemplary embodiment can be obtained also by the sheet feeding apparatus having the curve forming member 661 having such a configuration.

In addition, in the curve forming member 661 according to the fourth exemplary embodiment, the supporting projections 664 are each formed of the member having elasticity. Therefore, actions and effects similar to those of the curve forming member 561 according to the third exemplary embodiment can be obtained also in the curve forming member 661 according to the fourth exemplary embodiment.

Hereinbefore, the exemplary embodiments of the sheet feeding apparatus and the image forming system have been explained also including their working effects. However, the sheet feeding apparatus and image forming system of the present invention are not limited to the above-described embodiments, various modifications can be made within a scope not departing from the gist of the invention described in claims.

Although, in the above-described exemplary embodiments, there has been explained the example in which a curve forming portion of a curve forming member is provided only at an end portion of the downstream side of a stacking base in a conveying direction, the present invention is not limited to this. For example, the curve forming portion may be extended along the conveying direction of a stacking surface portion.

Figure 19:
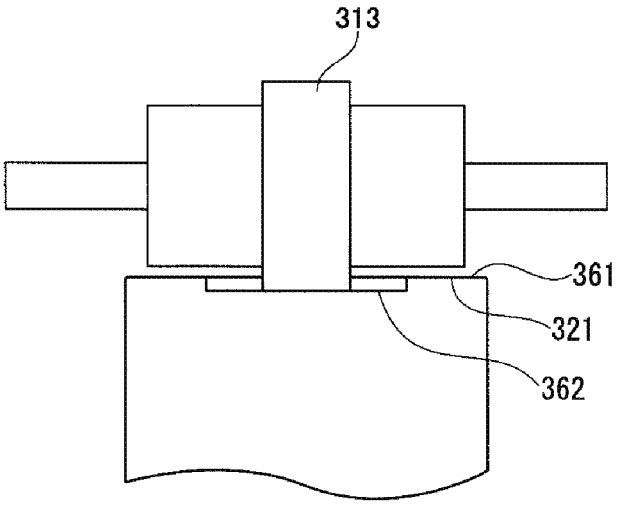
FIG. 19 is an elevational view of a pressing portion with a concave portion.

Furthermore, although there has been explained the example in which the curve forming portion having a height in a vertical direction being larger than a pressing surface portion is provided on both sides of the pressing surface portion in a width direction, the present invention is not limited to this. For example, the pressing surface portion may be formed as a concave portion on the stacking surface portion on which envelopes are stacked, and the height of the pressing surface portion and the vertical direction may be made lower than a height of the stacking surface portion in the vertical direction in the both sides of the pressing surface portion in the width direction(see Fig. 19). At this time, portions located on the both sides of the pressing surface portion in the stacking surface portion in the width direction each act as the curve forming portion. Also by such a configuration, a corrugation in the width direction can be imparted to end portions of the downstream side of the envelopes in the conveying direction by a sheet feeding roller and the pressing surface portion. As a result, it is possible for he end portions of the downstream side of the envelopes and the conveying direction to suppress drooping downward in the vertical direction.

What is claimed is:

1. A sheet feeding apparatus comprising:

a stacking base arranged on an elevating plate, the stacking base having a stacking surface portion, wherein the stacking surface portion is an upper surface of the stacking base disposed vertically above the elevating plate, the stacking surface portion being configured to support a stack of envelopes including a plurality of envelopes, the stacking surface portion being configured to support a center of the stack of envelopes such that sides of the envelopes extend laterally from the stacking surface portion in a width direction perpendicular to a conveying direction of the envelopes and the sides of the envelopes are unsupported;

a sheet feeding roller configured to contact a topmost envelope arranged at a top of the plurality of envelopes in the vertical direction, and convey the topmost envelope;

a curve forming member arranged on the stacking base, wherein the curve forming member is centered in the width direction with respect to the elevating plate and includes a pressing surface portion and a curve forming portion;

the pressing surface portion is pressed by the sheet feeding roller via the envelopes, the pressing surface portion being mounted on top of the stacking surface portion or disposed below the stacking surface portion and being arranged at a downstream end of the stacking surface portion; and the curve forming portion is arranged outside the sheet feeding roller in the width direction, that projects upward in the vertical direction above both the pressing surface portion and the stacking surface portion, and that supports the plurality of stacked envelopes.

2. The sheet feeding apparatus according to claim 1, wherein the curve forming portion is formed integrally with the pressing surface portion.

3. The sheet feeding apparatus according to claim 1, wherein the curve forming portion has elasticity.

4. The sheet feeding apparatus according to claim 1, further comprising an elevating portion that can elevate the stacking surface portion in the vertical direction, wherein the stacking surface portion is one surface of a stacking base provided at the elevating portion, and wherein the curve forming portion is supported so as to be able to be housed in the stacking base.

5. The sheet feeding apparatus according to claim 1, wherein the curve forming portion is detachably attached to the stacking surface portion.

6. The sheet feeding apparatus according to claim 1, wherein the pressing surface portion is a concave portion that is formed in the stacking surface portion, and is dented downward in the vertical direction from the stacking surface portion.

7. The sheet feeding apparatus according to claim 1, further comprising at least one support member arranged on the stacking surface portion, the at least one support member arranged rearward of the curve forming portion and providing a support surface above the stacking surface portion.

8. The sheet feeding apparatus according to claim 7, wherein the at least one support member includes a magnetic surface portion attracted to the stacking surface portion by a magnetic force, the at least one support member being detachably attached to the stacking surface portion by the magnetic surface portion.

9. The sheet feeding apparatus according to claim 1, wherein the elevating plate is vertically movable toward and away from the sheet feeding roller.

10. The sheet feeding apparatus according to claim 9, further comprising two side restricting members disposed on opposing side of the stacking surface portion and configured to restrict a position of the stack of envelopes in the width direction, each of the side restricting members being spaced from the stacking surface portion, thereby allowing the sides of the envelopes to extend laterally from the stacking surface portion in a width direction.

11. The sheet feeding apparatus according to claim 1, wherein the curve forming portion includes two projections disposed at opposing sides of the pressing surface portion in the width direction.

12. The sheet feeding apparatus according to claim 11, wherein the sheet feeding roller has a contact surface configured to contact the topmost envelope, and a length of the pressing surface portion in the width direction is longer than the contact surface of the sheet feeding roller such that the contact surface of the sheet feeding roller is disposed between the two projections in the width direction.

13. The sheet feeding apparatus according to claim 1, wherein the pressing surface portion is mounted on top of the stacking surface portion.

14. An image forming system comprising:

an image forming apparatus that forms an image on envelopes; and a sheet feeding apparatus that feeds the envelopes to the image forming apparatus, wherein the sheet feeding apparatus includes:

a stacking base arranged on an elevating plate, the stacking base having a stacking surface portion, wherein the stacking surface portion is an upper surface of the stacking base disposed vertically above the elevating plate, the stacking surface portion configured to support a stack of envelopes including a plurality of envelopes, the stacking surface portion being configured to support a center of the stack of envelopes such that sides of the envelopes extend laterally from the stacking surface portion in a width direction perpendicular to a conveying direction of the envelopes and the sides of the envelopes are unsupported;

a sheet feeding roller configured to contact a topmost envelope arranged at a top of the plurality of envelopes in the vertical direction, and convey the topmost envelope;

a curve forming member arranged on the stacking base, wherein the curve forming member is centered in the width direction with respect to the elevating plate and includes a pressing surface portion and a curve forming portion;

the pressing surface portion is pressed by the sheet feeding roller via the envelopes, the pressing surface portion being mounted on top of the stacking surface portion or disposed below the stacking surface portion and being arranged at a downstream end of the s tacking surface portion; and the curve forming portion is arranged outside the sheet feeding roller in the width direction, that projects upward in the vertical direction above both the pressing surface portion and the stacking surface portion, and that supports the plurality of stacked envelopes.

* * * * *